US006786120B2

(12) United States Patent
De Mori

(10) Patent No.: US 6,786,120 B2
(45) Date of Patent: Sep. 7, 2004

(54) SLICING MACHINE

(76) Inventor: Ezio De Mori, Via Livel 1/B, 31012 Cappella Maggiore (IT)

( * ) Notice: Subject to any disclaimer, the term of this patent is extended or adjusted under 35 U.S.C. 154(b) by 0 days.

(21) Appl. No.: 10/307,391

(22) Filed: Dec. 2, 2002

(65) Prior Publication Data

US 2003/0106406 A1 Jun. 12, 2003

(30) Foreign Application Priority Data

Dec. 7, 2001 (IT) ..... TV2001A0160

(51) Int. Cl.[7] ..... B26D 7/10; B26D 1/14

(52) U.S. Cl. ..... 83/170; 83/478; 426/518

(58) Field of Search ..... 99/329, 385, 473, 99/474, 331, 330, 342, 353, 357; 426/518, 520, 302, 282, 281, 280, 250; 241/65; 83/170, 478, 15, 168, 22, 16, 77, 932, 42, 62, 76.9, 23, 29, 56, 68

(56) References Cited

U.S. PATENT DOCUMENTS

| | | | | | |
|---|---|---|---|---|---|
| 1,972,250 | A | | 9/1934 | Strachan et al. | |
| 2,294,560 | A | * | 9/1942 | Bennett | 83/168 |
| 2,482,013 | A | * | 9/1949 | Marshall, Jr. | 83/168 |
| 3,927,588 | A | * | 12/1975 | Laderach | 83/15 |
| 5,197,681 | A | * | 3/1993 | Liebermann | 241/65 |
| 5,289,760 | A | * | 3/1994 | Barradas | 99/331 |
| 5,346,423 | A | * | 9/1994 | Caveza et al. | 446/479 |
| 5,666,868 | A | * | 9/1997 | Diete et al. | 83/168 |
| 5,931,018 | A | * | 8/1999 | Hall et al. | 62/331 |
| 6,058,829 | A | * | 5/2000 | Endres | 99/329 RT |
| 6,092,448 | A | * | 7/2000 | Cartwright et al. | 83/42 |
| 6,192,790 | B1 | * | 2/2001 | Balandier | 99/390 |
| 6,365,213 | B1 | * | 4/2002 | Taheri | 426/302 |
| 6,505,545 | B2 | * | 1/2003 | Kennedy et al. | 99/331 |
| 6,524,633 | B2 | * | 2/2003 | Rainbolt et al. | 426/59 |

FOREIGN PATENT DOCUMENTS

| | | |
|---|---|---|
| GB | 274 090 | 5/1928 |

* cited by examiner

*Primary Examiner*—Allan N. Shoap
*Assistant Examiner*—Ghassem Alie
(74) *Attorney, Agent, or Firm*—Guido Modiano; Albert Josif; Daniel O'Byrne

(57) ABSTRACT

A slicing machine, comprising a frame with which a supporting surface for a product to be sliced is slidingly associated, a support for a rotating blade being rigidly coupled to the surface, at least one element for heating the product to be sliced being provided proximate to the blade.

7 Claims, 3 Drawing Sheets

SLICING MACHINE

BACKGROUND OF THE INVENTION

The present invention relates to a slicing machine particularly suitable for slicing food products, such as for example salamis or ham.

Known slicing machines are currently used which comprise a base or frame, for resting on a surface, from which a supporting arm for a circular blade protrudes upwardly.

The blade can be turned by means of an electric motor.

A supporting carriage for the product to be sliced is slidingly associated along the frame and can be made to slide manually or automatically in a radial direction with respect to the circular blade, so as to cut a slice of product every time a translational motion is performed toward the blade.

Slicing machines are known which comprise devices for adjusting the thickness of the slices, for example by adjusting the distance of the plane of arrangement of the carriage with respect to the fixed plane of the blade, with a movement that is therefore perpendicular to the blade.

The main drawback of these conventional slicing machines is that sliced products are usually stored in a refrigerator and products to be consumed hot require a subsequent treatment in a pan or oven; this additional operation does not allow to cut thin slices, since in moving them in the pot or oven they might break up.

The need is also felt to prepare dishes for example by flavoring the slices of product; this is done manually by the user, with consequent unevenness, on each slice, of the flavoring, constituted for example by oil, lemon or any sauce.

This leads to the custom of abounding with the flavoring, using it in excess, so as to achieve the goal nonetheless: the direct consequence relates to a waste of flavoring, with considerable disadvantages in economical and food-health terms, since one is unable to dose the quantity of flavoring as a function of the regimens imposed by diets that are sometimes vital for ill individuals.

SUMMARY OF THE INVENTION

The aim of the present invention is therefore to solve the above noted problems eliminating the drawbacks of the cited known art, by providing a slicing machine that allows to achieve a quick and optimum slicing of a food product, such as for example a salami or ham, even if they are taken from a cold or refrigerated environment.

Within this aim, an object of the present invention is to provide a machine that allows to slice a product rapidly even if such product has a low or extremely low temperature.

Another object is to provide a machine that allows to simplify and optimize the step for preparing and/or flavoring the food product.

Another object is to provide a machine capable of improving the quality of the processing of the food product while reducing the costs and time required by the operator.

Another object is to be able to provide a machine adapted to provide simply and very rapidly a process suitable to provide a customization on each resulting slice of product.

Another object is to provide a machine that is structurally simple and has low manufacturing costs.

This aim and these and other objects that will become better apparent hereinafter are achieved by a slicing machine, according to claim 1.

BRIEF DESCRIPTION OF THE DRAWINGS

Further characteristics and advantages of the invention will become better apparent from the detailed description of a particular embodiment thereof, illustrated only by way of non-limitative example in the accompanying drawings, wherein.

DESCRIPTION OF THE PREFERRED EMBODIMENTS

Figure 1:
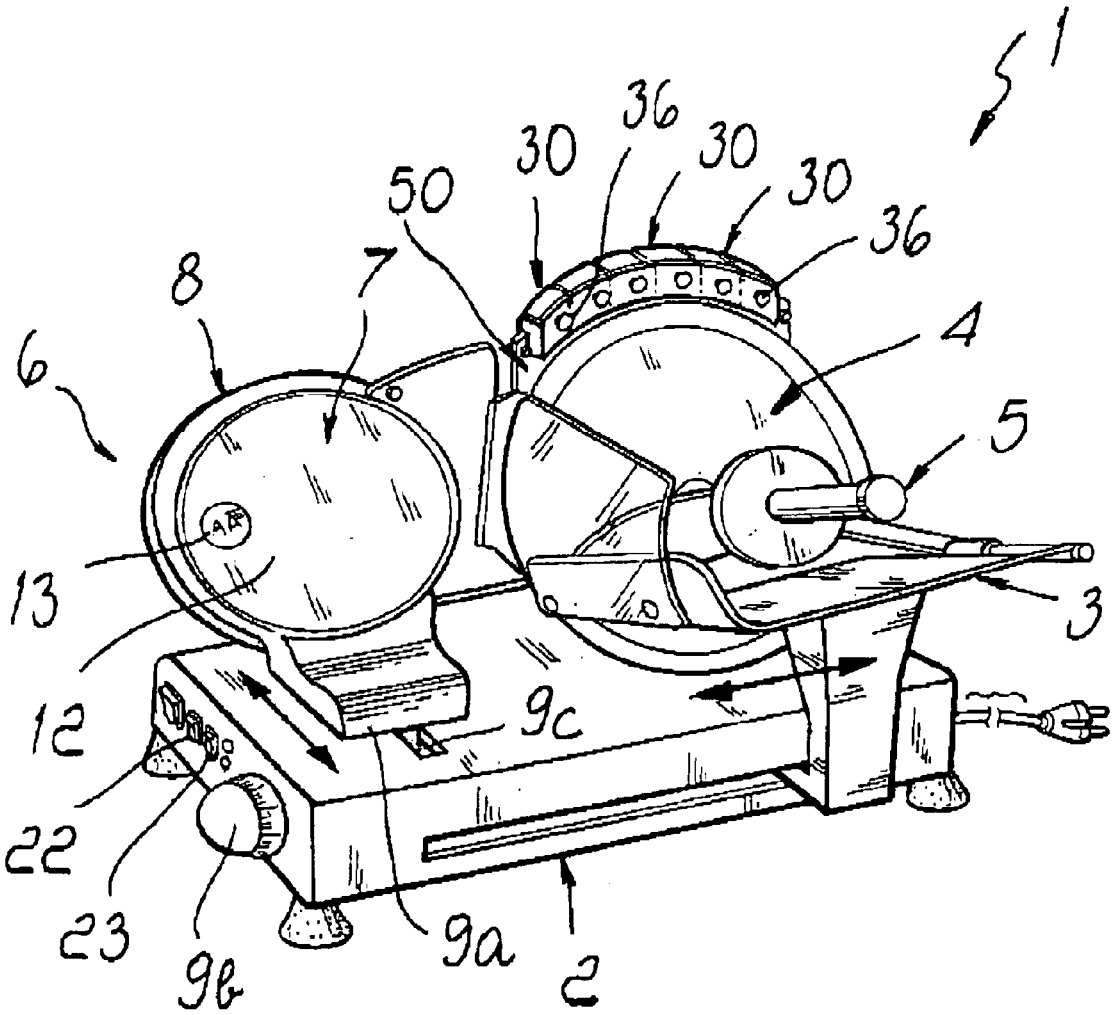
FIG. 1 is a perspective view of the slicing machine according to the invention.

With reference to the figures, the reference numeral 1 designates a slicing machine usable in particular for slicing food products, such as for example salamis or sausages.

The slicing machine 1 comprises a frame 2 with which a carriage or supporting surface, designated by the reference numeral 3, for the product to be sliced is slidingly associated.

The frame 2 comprises a wing or wall, designated by the reference numeral 50 in FIG. 1, that is suitable to support a circular blade 4, whose axis is preferably approximately horizontal or inclined and lies approximately at right angles to the direction in which the supporting surface 3 slides.

An arm 5 is further advantageously pivoted to the supporting surface 3 and allows the temporary locking of the food product and at the same time is suitable to constitute a grip means for moving said supporting surface 3.

A heating element, designated by the reference numeral 6, protrudes from the frame 2 in a position that is adjacent to the rotating blade 4 and is adapted to increase the surface temperature of the product to be sliced.

In the embodiment shown by way of example in the accompanying figures, the heating element 6 is advantageously constituted by a flat circular plate 7 accommodated within a box-like protective body 8 provided with a bracket 9*a* for connection to the frame 2.

The bracket 9*a* is advantageously associated with sliding means, actuated for example by a knob 9*b*, which are suitable to allow a translational motion of the heating element 6 along an axis that is approximately perpendicular to the axis along which the supporting surface 3 slides.

The plate 7 is conveniently arranged on a plane that is approximately parallel to, or coincident with, the plane of arrangement of the blade 4, so that the supporting surface 3 can slide between the region in front of the blade 4 and the region in front of the plate 7.

Figure 3:
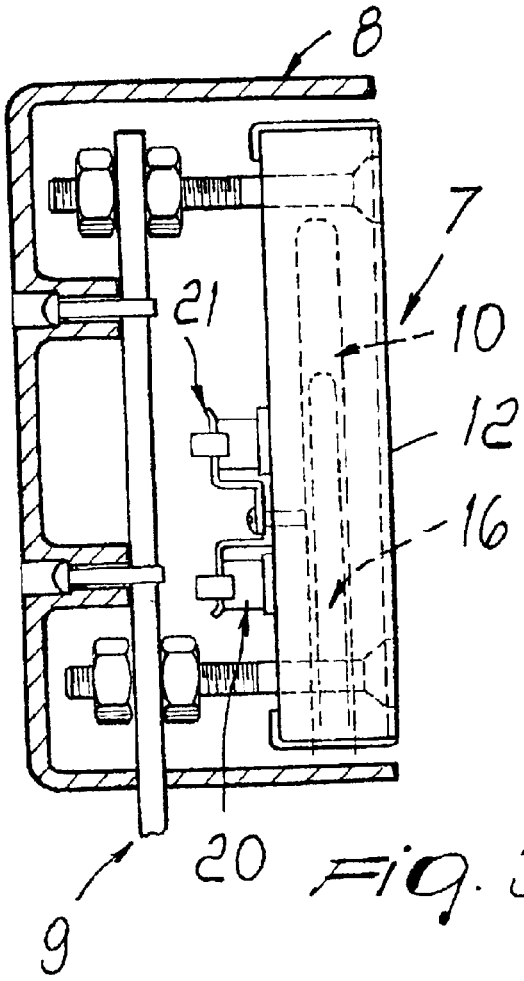
FIGS. 2 and 3 are respectively partially sectional front and side views of the heating element.
Figure 4:
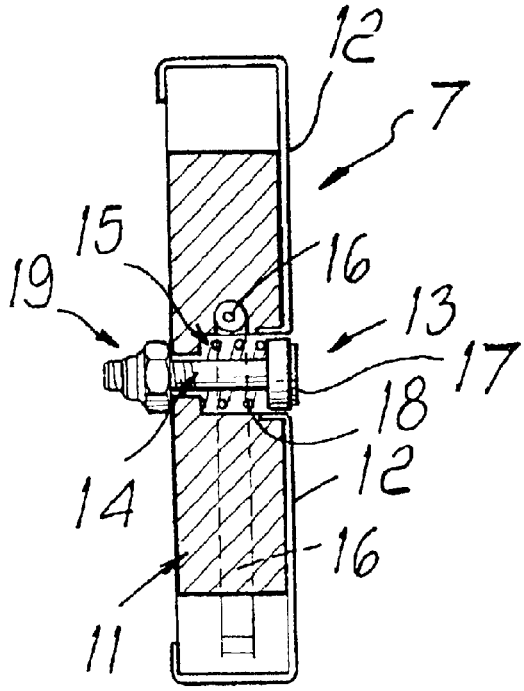
FIG. 4 is a sectional side view of FIG. 2, illustrating the heating element and the pad contained therein.
Figure 2:
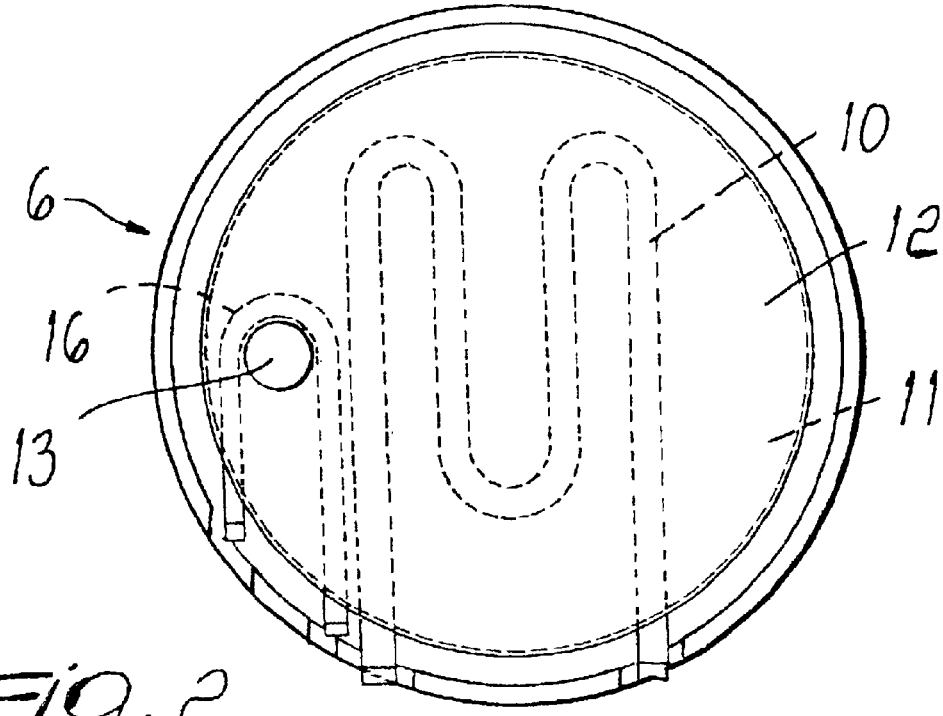

The plate 7 comprises heating means, constituted for example by one or more electrical resistors, such as a first electrical resistor, designated by the reference numeral 10 in FIGS. 2 and 3.

First electrical resistor 10, which is coil-shaped, is accommodated within a disk-like body 11 that constitutes the central part of the plate 7 and is advantageously made of a material having good or excellent heat conductivity.

The first resistor 10 and the disk-like body 11 are adapted to allow a uniform heating of the front surface, designated by the reference numeral 12, of the plate 7, so as to ensure the heating of the surface of the food product that is placed adjacent to the heating element 6 during the cutting operation.

The front surface 12 of the plate 7 is preferably smooth and made of metallic material, such as for example stainless steel or aluminum.

Proximate to the plate 7, or preferably inside it, it is possible to arrange at least one pad 13, which is heated and optionally movable and is suitable to imprint one or more distinctive markings on the product to be sliced.

In particular, the pad 13 is advantageously constituted by a punch, designated by the reference numeral 14, which is arranged so that its axis is approximately parallel to the axis of the plate 7 and is accommodated, in the example shown in the figures, within a seat 15 formed in the plate 7.

The pad 13 is heated preferably by means of a second electric resistor, designated by the reference numeral 16, which is arranged in the disk-like body 11 proximate to said pad 13.

The punch 14 has a head 17 that is advantageously flat and parallel to the front surface 12 of the plate 7 and is arranged so as to protrude slightly with respect to the surface 12.

An elastically compressible element, such as a cylindrical spring 18, is advantageously arranged coaxially to the punch 14 and acts between the head 17 of the punch 14 and the bottom of the seat 15.

In this manner, the pad 13 can slide axially within the seat 15, at the same time preloading the spring 18, which is suitable to allow the pad to return to the original position.

The pad 13 cannot escape from the seat 15 due to the presence of locking means, advantageously constituted by a nut 19 that is associated with the punch 14 in the opposite position with respect to the head 17 and protrudes externally from the disk-like body 11.

The temperature of the first resistor 10 and of the second resistor 16 is controlled by way of two separate control devices, such as for example a first thermostat and a second thermostat, designated by the reference numerals 20 and 21, of the type with fixed or variable heat setting, which are suitable to ensure that the preset temperatures on the front surface 12 of the plate 7 and on the head 17 of the punch 14 are maintained.

The temperature of the head 17 is advantageously kept higher than the temperature of the plate 7, since it must be sufficient not only to produce the surface heating of the food product but most of all to obtain a marking or imprint on the cutting surface.

The thermostats 20 and 21 and the electric resistors 10 and 16 are advantageously activated independently, for example by means of a first switch 22 for controlling the heating of the plate 7, and by means of a second switch 23 for controlling the heating of the pad 13.

The operation of the slicing machine 1 is as follows: with reference to FIG. 1, the user can arrange the product to be sliced on the supporting surface 3 and, after turning the blade 4, start to slice the product.

Each time the supporting surface 3 or just the product to be sliced is moved at the region in front of the heating element 6, the cutting surface of the food product is arranged proximate to, or in contact with, the plate 7, so as to undergo a temperature increase.

If the pad 13 is present and is heated, the cutting surface is also marked, since the product rests on the protruding head 17 of the punch 14, which is advantageously heated to a high temperature.

To allow more effective marking, the sliding guide of the supporting surface or carriage 3 can be provided so as to allow, at the stroke limit proximate to the heating element, a movement of the carriage along a curved path that is suitable to move the product toward the plate 7, thus ensuring contact between the cutting surface and the pad 13.

In this manner, whenever the supporting surface 3 moves toward the heating element 6, and therefore toward the blade 4, the product undergoes surface heating and the heated surface is then cut.

The slicing machine 1, moreover, can comprise advantageously one or more liquid dosage units, generally designated by the reference numeral 30, which are suitable to contain for example dressings and/or mixes and/or flavorings for the product to be sliced.

The dosage units 30 protrude from the wing or wall 50 for supporting the blade 4, and are arranged in succession for example proximate to the upper edge of the blade.

Each one of the dosage units 30 comprises a box-like element 31 that constitutes the reservoir for a selected sauce, mix or flavoring.

Access to the internal compartment 32 of the box-like element 31 is allowed by way of an upper cover 33.

The box-like element 31 is associated, in a lower region, with a nozzle 34 by way of a duct 35 that is preferably vertical or oblique, so as to ensure a downward outflow of the liquid by gravity.

The dosage unit 30 comprises means for closing and adjusting the flow of liquid, for example a cock, designated by the reference numeral 36, for controlling the flow of the duct 35.

Figure 5:
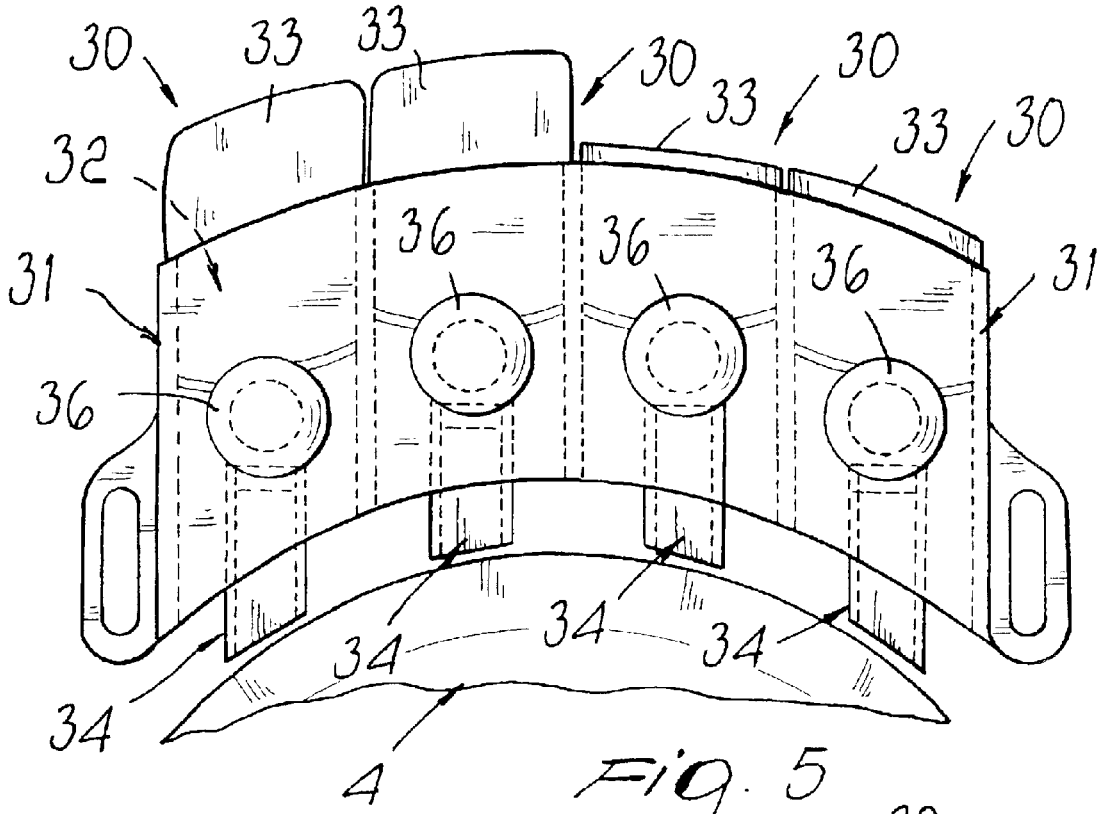
FIGS. 5 and 6 are respectively a front view and a top plan view of a plurality of liquid dosage units arranged above the blade.
Figure 6:
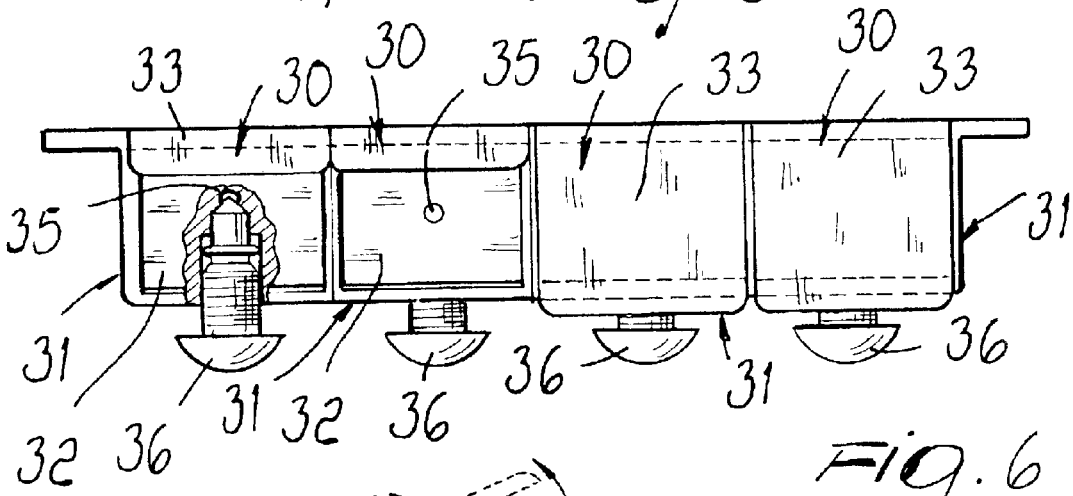
Figure 7:
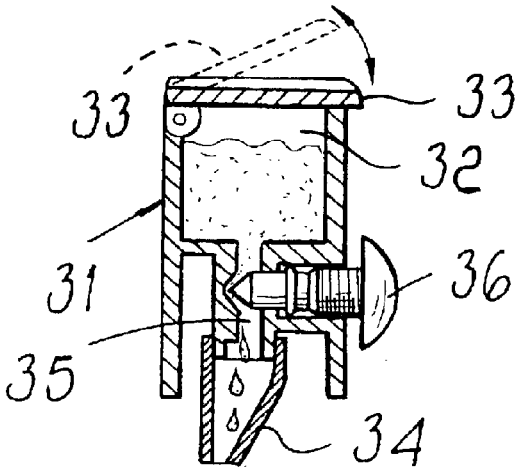
FIG. 7 is a sectional side view of one of the liquid dosage units.

The use of the dosage units 30 is therefore as follows: with reference to FIG. 5, the user, after filling one or more dosage units with liquid flavoring substances for the product, can adjust the outflow of the selected substances from the nozzle 34 by turning the cock 36.

These substances fall in drops or as a jet onto the blade 4, allowing even distribution thereof on each slice being cut.

It has thus been found that the invention has achieved the intended aim and objects, a slicing machine having been provided which allows to cut a food product directly even if it has just been taken out of a low-temperature environment, such as a refrigerator.

Since heating is performed slice by slice and preset to optimum temperature values, the product obtained after cutting is qualitatively optimum and ready for consumption.

It is thus possible to cut very thin slices without the drawback due to their possible breakage.

The product, moreover, can be flavored directly during cutting, with an operation that is performed slice by slice, thus optimizing the step of preparation and/or flavoring of the food product, consuming the calibrated doses of flavoring with respect to the weight of cut product.

It is also possible to achieve automatic marking of each individual slice, thus providing a customization by applying fancy lettering or, for example in the case of a restaurant or hotel, of their trademark.

The invention is of course susceptible of numerous modifications and variations, all of which are within the scope of the appended claims.

Thus, for example, it is possible to provide a slicing machine that has only the heating element and therefore does not have the marking pad and the dosage units, or to provide a slicing machine that does not have the heating element and comprises only the dosage units arranged proximate to the blade, or still it is possible to provide a slicing machine that has the heating element and the pad but does not have the dosage units.

Furthermore, the slicing machine can be of the vertical type with the heating element associated again in a region that is proximate to the blade or to the product to be sliced.

The materials used, as well as the dimensions that constitute the individual components of the machine according to the invention, may of course be more pertinent according to specific requirements.

The various means for performing certain different functions need not certainly coexist only in the illustrated embodiment but can be present per se in many embodiments, including those that are not illustrated.

The disclosures in Italian Patent Application No. TV2001A000160 from which this application claims priority are incorporated herein by reference.

What is claimed is:

1. A slicing machine (1) comprising an approximately horizontal frame (2) with which a supporting surface (3) for a product to be sliced is slidably associated, a rotating circular blade (4) which rotates around an axis which is preferably approximately horizontal or inclined with respect to said frame (2) and which is approximately perpendicular with respect to the sliding direction of said supporting surface (3), comprising, adjacent to said rotating blade (4), at least one heating element (6) for increasing the surface temperature of said product to be sliced, said heating element (6) comprising at least one plate (7) arranged on a plane approximately parallel to, or coincident with, the plane of arrangement of said rotating blade (4) so that said supporting surface (3) can slide between the region in front of said rotating blade (4) and the region in front of said plate (7).

2. The slicing machine according to claim 1, wherein said plate (7) is plane and accommodated within a box-like protective body (8) provided with a bracket **(9*a*) for connection to said frame (2)**.

3. The slicing machine according to claim 2, wherein said bracket **(9*a*) is associated with conventional sliding means actuated by a knob (9*b*) which can be activated by the user, said sliding means (9*c*) being suitable to allow a translational motion of said heating element (6) along an axis that is approximately perpendicular to the axis along which said supporting surface (3)** slides.

4. The slicing machine according to anyone of the preceding claims wherein said plate (7) comprises first healing means controlled at least by a first thermostat (20) and/or by a first switch (22), said first heating mean, being suitable to allow a uniform heating of the front surface (12) of said plate (7).

5. The slicing machine according to claim 4, wherein said first heating means of said plate (7) comprise at least a first electrical resistor (10), accommodated within a disk-like body (11) which constitutes the central part of said plate (7) and which is preferably made of a heat-conducting material.

6. The slicing machine according to claim 5, wherein said first electrical resistor (10) is coil-shaped.

7. The slicing machine according to anyone of the preceding claims, wherein said disk-like body (11) is at least partially clad with a film that constitutes a heating surface.

* * * * *